US010392888B2

(12) United States Patent
Robertson et al.

(10) Patent No.: US 10,392,888 B2
(45) Date of Patent: Aug. 27, 2019

(54) CENTRALIZING AND PROTECTIVE ADAPTER FOR DOWNHOLE TORCH AND METHOD OF USE

(71) Applicant: Robertson Intellectual Properties, LLC, Mansfield, TX (US)

(72) Inventors: Michael C. Robertson, Mansfield, TX (US); Antony F. Grattan, Mansfield, TX (US); Douglas J. Streibich, Fort Worth, TX (US); Amy Stephens, Mansfield, TX (US); William F. Boelte, New Iberia, LA (US); Cory Huggins, Mansfield, TX (US)

(73) Assignee: ROBERTSON INTELLECTUAL PROPERTIES, LLC, Mansfield, TX (US)

( * ) Notice: Subject to any disclaimer, the term of this patent is extended or adjusted under 35 U.S.C. 154(b) by 160 days.

(21) Appl. No.: 15/250,771

(22) Filed: Aug. 29, 2016

(65) Prior Publication Data

US 2016/0369597 A1 Dec. 22, 2016

Related U.S. Application Data

(63) Continuation-in-part of application No. 15/237,438, filed on Aug. 15, 2016, now Pat. No. 9,945,197, and a continuation-in-part of application No. 15/147,755, filed on May 5, 2016, and a continuation-in-part of application No. 14/930,369, filed on Nov. 2, 2015, now Pat. No. 10,246,961, and a continuation-in-part (Continued)

(51) Int. Cl.
*E21B 31/00* (2006.01)
*E21B 29/02* (2006.01)

(52) U.S. Cl.
CPC ..... *E21B 31/002* (2013.01); *E21B 29/02* (2013.01)

(58) Field of Classification Search
CPC ..... E21B 31/002; E21B 31/18; E21B 29/02; E21B 41/00; E21B 41/0078; E21B 43/116; E21B 36/00; E21B 23/01; E21B 23/04
See application file for complete search history.

(56) References Cited

U.S. PATENT DOCUMENTS 2,890,757 A * 6/1959 Bodine ..... E21B 31/005 166/177.1
4,619,318 A 10/1986 Terrell et al.
(Continued)

FOREIGN PATENT DOCUMENTS

WO WO2014142899 A1 9/2014

*Primary Examiner* — George S Gray

(57) ABSTRACT

Apparatus and adapter are usable for aligning downhole torch apparatuses and cutting devices, including axial pyro torches, circulating pyro torches, and radial cutting and perforating torches, within a wellbore for removal of one or more downhole obstructions. The torch and/or cutting apparatus comprises a body having a nozzle adapted to project a fuel load, such as molten thermite or molten thermite with a polymer, in a direction aligned with the obstruction. The adapter comprises protruding elements for eliminating or diminishing damage to the area surrounding the obstruction, including the inner walls of the wellbore and/or casing, and can further comprise centralizers for alignment of the apparatus with the obstruction, within the wellbore.

22 Claims, 10 Drawing Sheets

Related U.S. Application Data of application No. 14/727,609, filed on Jun. 1, 2015, now Pat. No. 9,745,813, and a continuation-in-part of application No. 13/815,694, filed on Mar. 14, 2013, now Pat. No. 9,580,984, and a continuation-in-part of application No. 13/507,732, filed on Jul. 24, 2012, now Pat. No. 9,863,235.

(60) Provisional application No. 62/210,937, filed on Aug. 27, 2015.

(56) References Cited

U.S. PATENT DOCUMENTS

| | | | | |
|---|---|---|---|---|
| 9,580,984 | B2 * | 2/2017 | Robertson | E21B 29/02 |
| 2008/0257549 | A1 | 10/2008 | Swor et al. | |
| 2011/0240367 | A1 | 10/2011 | Guidry et al. | |
| 2014/0262328 | A1 * | 9/2014 | Robertson | E21B 29/02 166/376 |
| 2015/0376958 | A1 * | 12/2015 | Ringgenberg | E21B 17/06 166/373 |
| 2017/0167216 | A1 * | 6/2017 | Robertson | E21B 31/06 |

* cited by examiner

CENTRALIZING AND PROTECTIVE ADAPTER FOR DOWNHOLE TORCH AND METHOD OF USE

CROSS REFERENCE TO RELATED APPLICATIONS

The present application is a non-provisional application that claims the benefit of, and the priority from, U.S. Provisional Patent Application No. 62/210,937 having a title of "A Centralizing and Protective Adapter for Downhole Torch and Method of Use," filed Aug. 27, 2015, and is a continuation-in-part of U.S. patent application Ser. No. 13/507,732 having a title of "Permanent Or Removable Positioning Apparatus And Method For Downhole Tool Operations," filed Jul. 24, 2012, U.S. patent application Ser. No. 13/815,694 having a title of "Apparatus And Method For Overcoming An Obstruction In A Wellbore," filed Mar. 14, 2013, U.S. patent application Ser. No. 15/237,438 having a title of "Tool Positioning And Latching System," filed Aug. 15, 2016, U.S. patent application Ser. No. 14/727,609 having a title of "Anchor System For Pipe Cutting Apparatus," filed Jun. 1, 2015, U.S. patent application Ser. No. 15/147,755 having a title of "Downhole Positioning And Anchoring Device," filed May 5, 2016, and U.S. patent application Ser. No. 14/930,369 having a title of "Setting Tool for Downhole Applications," filed Nov. 2, 2015, all of which are incorporated in their entireties herein.

FIELD

Embodiments usable within the scope of the present disclosure relate, generally, to adapters and alignment devices usable as part of downhole torches and cutting devices, including axial pyro torches, circulating pyro torches, and radial cutting and perforating torches, within a wellbore. Embodiments of the present invention further include methods of using the adapters and alignment devices attached to the downhole torches for aligning the downhole torches or cutting devices with downhole obstructions. Further embodiments include the adapters and alignment devices comprising protective shields for eliminating or diminishing damage to the area surrounding the obstruction, including the inner walls of the wellbore and/or casing.

BACKGROUND

A common problem associated with downhole operations in a wellbore is presented with the presence and ultimate removal of obstructions, inoperable equipment, or temporary downhole tools that have complete the intended usefulness within the wellbore. Existing methods for removal of the obstruction and/or inoperable equipment has led, in many cases, to the further obstruction of the wellbore caused from the breaking up of the obstruction and/or the equipment, which then drops further down into the wellbore. Existing methods have included drilling, cutting away, or consuming (e.g., heat, chemicals) the obstruction and/or the equipment from the wellbore, which can cause damage to the inner wall of the wellbore. In addition, the cutting away, as set forth above, can lead to further obstruction in a different or lower position within the wellbore.

Another problem associated with the removal of the obstruction or equipment within a wellbore regards the movement of the obstruction or the inoperable equipment while being cut away or removed. The drilling, cutting, or consuming methods used previously do not match the shape of the removal method to the obstruction or the downhole tool, which allows the consuming methods to move around during operation. This movement can diminish the successful removal of the obstruction and/or inoperable equipment, causing expensive delays in the operation of the well.

Still another problem associated with the removal of obstructions within a wellbore regards the swing or movement of a cutting device. This swing or movement can lead to a misalignment of the cutting device, which then causes a diminished or unsuccessful removal of the obstruction and/or downhole tool. In instances where the cutting device is a downhole torch, the swing or movement resulting in the misalignment may cause incomplete removal, or may require the downhole torch to be retrieved and relocated downhole for accurate removal of the obstruction and/or inoperable equipment. Accordingly, a significant amount of time and/or change of equipment may be required, which ultimately prevents the progress of the downhole operations and leads to considerable expense.

Therefore, a need exists for apparatus and methods usable to accurately align and capture a target for cutting, penetrating, perforating or eroding away the target, which presents a blockage, obstruction, hindrance to travel, and/or inadequate flow path in a wellbore.

A need exists for apparatus and methods that can accurately align a cutting device (e.g., downhole torch) with a target and securely attach the cutting device to the target for successful removal within a wellbore.

A need exists for apparatus and methods that can protect and shield a surrounding area (e.g., inner walls of a wellbore or casing) from damage while an obstruction or inoperable equipment is being removed by cutting, perforating, penetrating, or eroding devices.

The present embodiments meet these needs.

SUMMARY

Embodiments of the present disclosure relate generally to apparatus and methods usable for aligning a downhole apparatus usable for penetrating a downhole target (e.g., a packer, setting tool, or similar sealing/isolating device, a safety valve, a ball valve, a restriction, an obstruction, debris, etc.) within a wellbore. In addition to the alignment apparatus (e.g., adapter) being usable for capturing and aligning the target with the downhole apparatus for cutting, perforating, penetrating, or eroding away the target, the adapter or alignment device can provide a protective shield to prevent or diminish any damage to the surrounding area (e.g., inner wall of the wellbore or casing).

The apparatus, for penetrating the downhole target, can include a torch comprising a torch body having a nozzle formed at an end thereof, the nozzle being adapted to project a medium in a direction generally parallel to the axis of the wellbore (e.g., in a downhole or uphole direction). An example of this torch apparatus is discussed in U.S Patent Publication No. 2014/0262328, the disclosure of which is incorporated herein in its entirety. As such, the torch apparatus can be used to project molten fuel (e.g., molten thermite, projected fuel load (i.e., molten thermite, molten thermite and gas-producing polymer)), a perforating jet or object, a blade, a corrosive medium, or other similar means for eroding, penetrating, perforating, or otherwise overcoming a blockage or restriction. The apparatus can be positioned above the obstruction or blockage for projecting in a downhole (e.g., axial) direction to penetrate, perforate, or erode the obstruction or blockage. Alternatively, the apparatus can be positioned below the obstruction or blockage for projecting in an uphole direction or in a downhole (e.g., axial) direction after placement of the apparatus above a blockage, or in an uphole direction (e.g., when positioned beneath a safety valve or sealing device that must later be overcome or removed).

A fuel load can be associated with the torch body, e.g., by placement therein, or placement in an adjacent body or receptacle that can be threaded or otherwise attached and/or associated with the torch body. An initiation source (e.g., a thermal generator or similar device) can be provided, in communication with the fuel load, for causing consumption of the fuel load and subsequent projection of a medium through the nozzle, generally parallel to the longitudinal axis of the apparatus and the axis of the wellbore, thus enabling the medium to affect a wellbore obstruction located in an uphole or downhole direction relative to the apparatus.

For example, in an embodiment, the torch apparatus can be a downhole torch or cutter having a nozzle formed in, attached to, or otherwise associated with the uphole and/or downhole end thereof, and the apparatus can be provided with a power source, such as thermite. Actuation of the initiation source thereby causes molten thermite to be projected through the nozzle in an uphole or downhole direction, to erode, degrade, penetrate, or otherwise affect a downhole obstruction. In various embodiments, one or more additional nozzles may also be provided, oriented to project a medium at an angle (e.g., perpendicular) relative to the axis of the apparatus, e.g., to allow selective and/or simultaneous use of the apparatus to cut, perforate, penetrate, and/or otherwise affect a wellbore conduit and/or a formation.

In an embodiment of the invention, an apparatus to modify or remove an obstruction or a downhole tool within a wellbore may include a tubular body having a first end and a second end and configured to contain a fuel load and an initiator. The fuel load may be initiated to produce a molten thermite. The embodiment may also include a nozzle positioned at the second end of the tubular body and configured to project the molten thermite onto the obstruction or the downhole tool, and a first adapter configured to attach to the tubular body. The first adapter includes a sealing member for connecting and sealing the first adapter to the tubular body and one or more protruding elements configured to align the nozzle over the obstruction or the downhole tool. The first adapter may be configured to at least partially surround the obstruction or the downhole tool such that the aligned nozzle projects the molten thermite (directly) onto the obstruction or the downhole tool, and the first adapter may form a barrier between a surrounding area of the wellbore and the projected molten thermite.

In an embodiment, the apparatus may include a downhole perforating torch, a downhole cutting torch, an axial pyro torch, or combinations thereof. Modifying or removing the obstruction or the downhole tool may include eroding the obstruction or the downhole tool, degrading the obstruction or the downhole tool, cutting through the obstruction or the downhole tool, penetrating through the obstruction or the downhole tool, perforating the obstruction or the downhole tool, or removing the obstruction or the downhole tool. In certain embodiments, the fuel load may include thermite or thermite and one or more gas-producing polymers.

In certain embodiments of the apparatus, the nozzle may include a selected geometry that corresponds to a shape of the obstruction or the downhole tool, allows positioning of the nozzle proximate to the obstruction or the downhole tool, enhances the effectiveness of the apparatus for removing the obstruction or the downhole tool, or combinations thereof. The nozzle may be adapted to project the molten thermite in a direction generally parallel to the axis of the wellbore and in a downhole or uphole direction. Also, the first adapter may include one or more locating centralizers to guide and centralize the apparatus for acting on the obstruction or the downhole tool, and the one or more locating centralizers may include angled faces that slide over the obstruction or the downhole tool as the apparatus is positioned to align the nozzle with the obstruction or the downhole tool.

In certain embodiments, the apparatus may include an anchoring device to position the apparatus and minimize movement of the apparatus during projection of the molten thermite. The downhole tool in certain embodiments may include a consumable plug, and the connection between the first adapter and the tubular body further may include an internal threadable connection, an external threadable connection, fasteners, set screws, or combinations thereof. In certain embodiments of the apparatus, the one or more protruding elements may extend beyond the second end of the apparatus to form the barrier for protecting the apparatus and the surrounding area of the wellbore during the projection of the molten thermite. The first adapter may include a plug that is sealed over or onto the nozzle to prevent contamination of the nozzle prior to projection of the molten thermite, and the projection of the molten thermite may erode or remove the plug.

Certain embodiments of the apparatus may include a second adapter configured to attach to the tubular body in replacement of the first external adapter, and the second adapter may include one or more protruding elements including geometry different from the first adapter. The surrounding area may include areas above and below the obstruction or the downhole tool.

Embodiments of the invention may include a method of modifying or removing an obstruction from a wellbore that includes lowering an apparatus into a wellbore. The apparatus may include a tubular body configured to contain a fuel load and an initiator, a nozzle positioned at the second end of the tubular body and configured to project the molten thermite onto the obstruction, and a first adapter configured to attach to the tubular body. The first adapter may include a sealing member for connecting and sealing the first adapter to the tubular body and one or more protruding elements configured to align the nozzle over the obstruction, and the first adapter may form a barrier between a surrounding area of the wellbore and the projected molten thermite. The method may include aligning the nozzle over the obstruction with the first protruding element. The first adapter may be configured to at least partially surround the obstruction. The method may also include initiating the fuel load to produce the molten thermite, projecting the molten thermite through the aligned nozzle to modify or remove at least a portion of the obstruction with the projected molten thermite, and preventing damage to a first area of the wellbore surrounding the obstruction with the one or more protruding elements.

In certain embodiments, the method may include retrieving the apparatus from the wellbore, replacing the first external adapter with a second external adapter, lowering the apparatus into the wellbore with the second external adapter, and initiating an additional fuel load onto the obstruction.

Embodiments of the invention may also include an adapter for a downhole apparatus usable for modifying or removing a downhole tool in a wellbore. The adapter may have a body including a nozzle at a first end of the body. The nozzle may be configured to project molten thermite. The adapter may have at least one protruding element configured to protrude from the first end of the body, and the protruding element may include a specific shape that at least partially surrounds a specific profile of the downhole tool when the downhole apparatus is lowered into the wellbore. The adapter may also include securing structures configured to maintain a connection between the adapter and the downhole tool while the nozzle projects the molten thermite.

In certain embodiments, the securing structures are configured to buckle or shear in response to a predetermined load, and the securing structures may include tabs, a tab ring, teeth, or combinations thereof

BRIEF DESCRIPTION OF THE DRAWINGS

In the detailed description of various embodiments usable within the scope of the present disclosure, presented below, reference is made to the accompanying drawings, in which.

One or more embodiments are described below with reference to the listed FIGS.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1A:
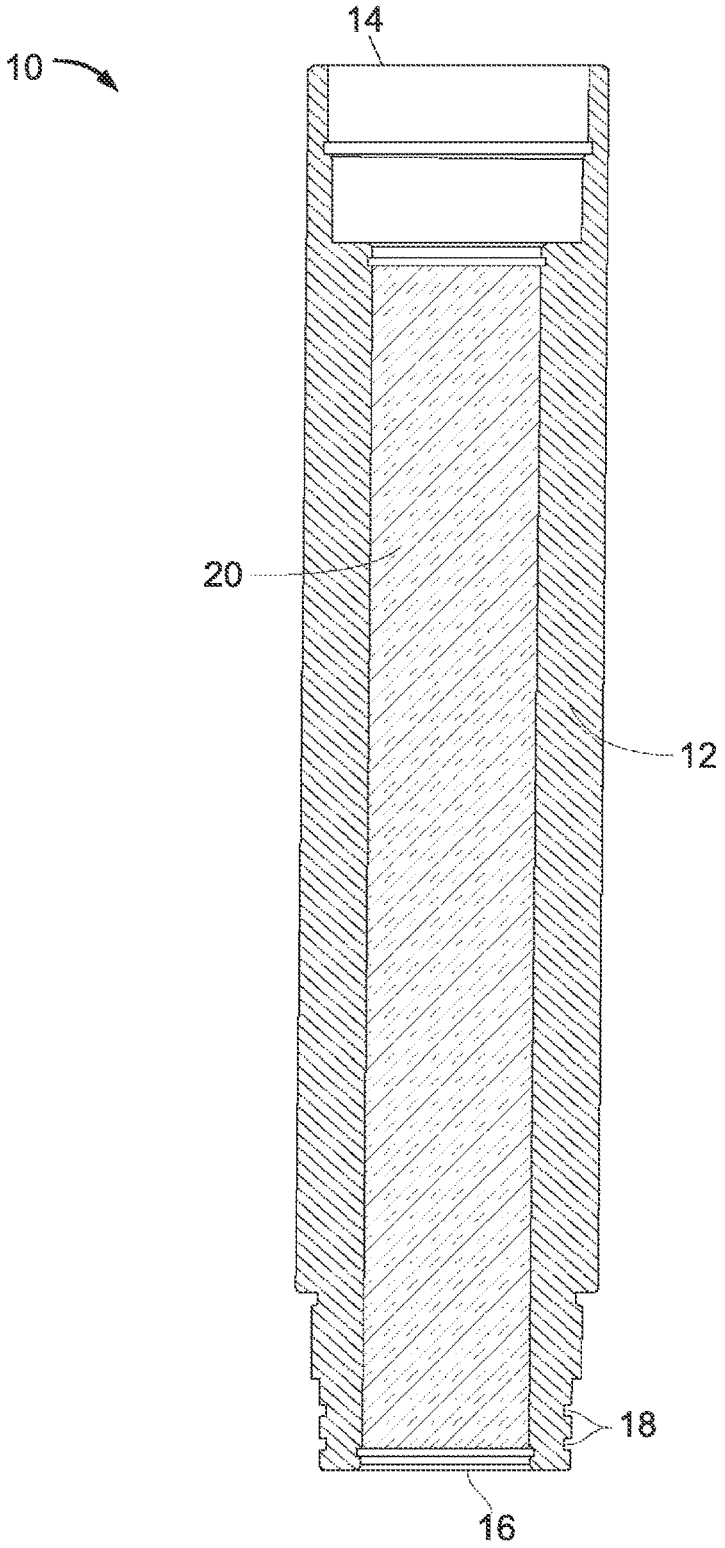
FIG. 1A depicts a cross-sectional view of an embodiment of an apparatus usable to project a medium in a direction generally parallel to an axis of a wellbore.

The disclosed embodiments are directed to adapters and alignment devices for use with torches, for example pyro torches, within a wellbore. The adapters described below are used to align and capture obstructions and downhole tools (e.g., inoperable, corroded, broken, semi-permanent, or temporary downhole tools that have completed usefulness) within the wellbore that are otherwise irretrievable and, therefore, must be cut or annihilated to open up flow through the wellbore. To modify or remove the obstruction, a torch apparatus, such as an axial pyro torch, employing an incendiary fuel (e.g., thermite or thermite and a polymer) is used to cut or burn through the obstruction. For example, FIG. 1A illustrates a cross-sectional view of an embodiment of an apparatus (10) (e.g., a torch) adapted for projecting a medium in an axial (e.g., downhole or uphole) direction within a wellbore. It should be understood that while FIG. 1A depicts a generally tubular, torch-like apparatus as an exemplary embodiment, any type of cutter, perforator (e.g., a perforating gun), or any other type of device, configured to project a medium in a manner to affect an obstruction in a wellbore, can be used with the adapter, as described above and below, without departing from the scope of the present disclosure. The tubular body can be, for example, any elongated body with a round (e.g., cylindrical), rectangular, oval, square, or other polygonal shaped cross-sectional body comprising a bore, passageway or opening therein. The bore or passageway can store a fuel load. Additionally, as described below, while the depicted embodiment can be used as an apparatus for projecting a medium in an axial direction within a wellbore, the depicted embodiment could alternatively be attached (e.g., threaded) to one or more other apparatus usable to project a medium in an axial direction, such that the depicted apparatus (10) is usable as an associated container for retaining a fuel load therein.

Figure 1B:
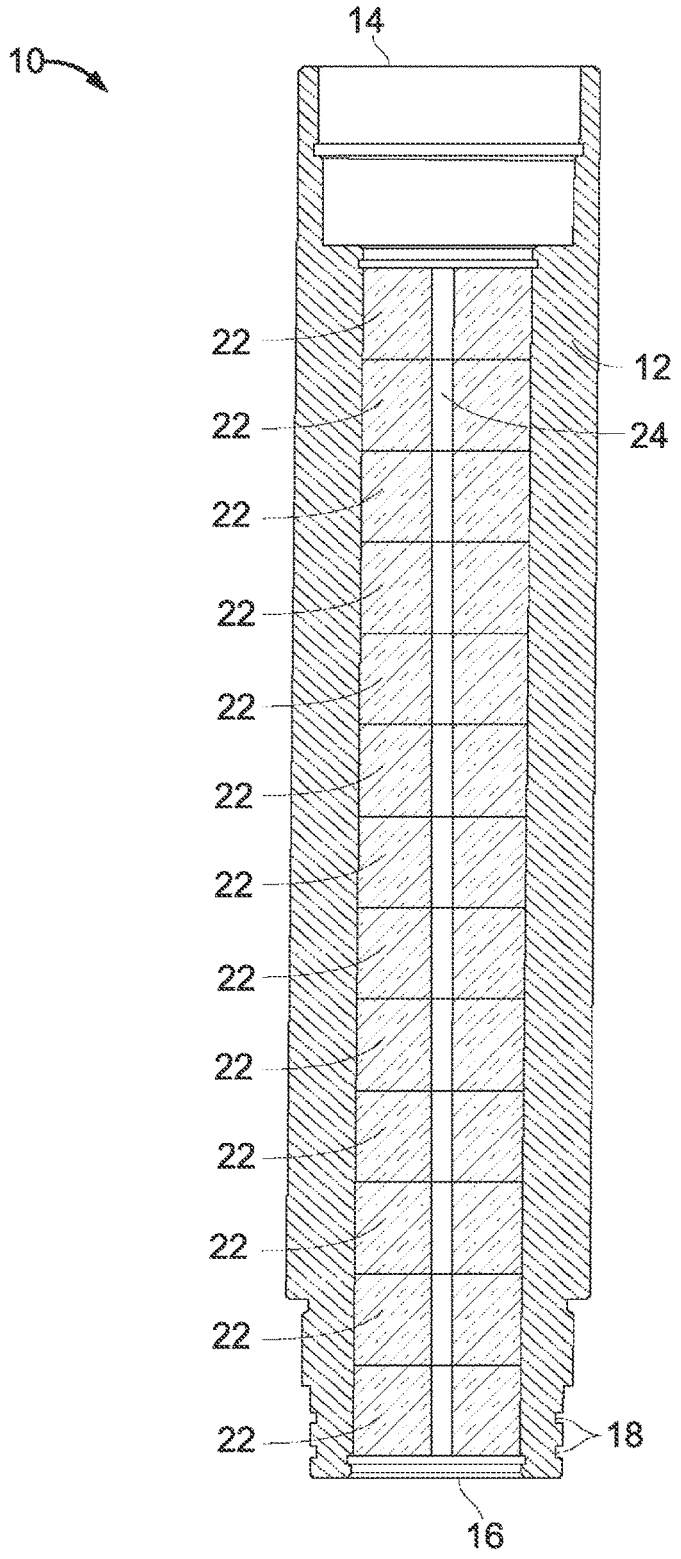
FIG. 1B depicts a cross-sectional view of an alternate embodiment of the apparatus of FIG. 1A.

Specifically, the depicted apparatus (10) is shown having an elongate, tubular body (12) having a box end (14) and a pin end (16). The pin end (16) is depicted having sealing elements (18) (e.g., O-rings or similar elastomeric and/or sealing members) associated therewith. A fuel load (20) is shown disposed within and substantially filling the central bore of the body (12). In an embodiment, the fuel load (20) can include thermite and/or a mixture of thermite and one or more polymers adapted to produce a gas and/or force as the thermite combusts, such as the power source described in U.S. Pat. No. 8,196,515, which is incorporated herein by reference in its entirety. FIG. 1A depicts the body (12) containing a single piece of thermite (e.g., an elongate pellet or a densely packed concentration), though it should be understood that the fuel load (20) can include any type of usable power source having any form and/or quantity. For example, FIG. 1B depicts an alternate embodiment of an apparatus (10), in which the fuel load includes multiple, discrete pellets of thermite (22), each having a central passage therethrough (e.g., for increasing surface area), to define a continuous central passage (24).

In operation, either the box end (14) or pin end (16) of the depicted apparatus (10) can be configured to function as a nozzle, such that when the fuel load (20, 22) is consumed (e.g., through actuation of a thermal generator or other type of ignition source), a medium (e.g., molten thermite, molten thermite and a gas-producing polymer) is projected through the box end (14), the pin end (16), or combinations thereof, generally parallel to the axis of the body (12) and the axis of a wellbore within which the body (12) is positioned. The medium can subsequently affect an obstruction within a wellbore (e.g., debris, a valve, a setting tool, a restriction, or other similar types of obstacles) located in an axial direction (uphole or downhole) relative to the apparatus (10), e.g., by at least partially degrading, perforating, penetrating, and/or eroding the obstruction. The medium may also be projected at a downhole tool (e.g., a consumable plug, permanent plug, fishing tool, hanger, jar, packer, shock tool, etc.) for removal of the downhole tool from the wellbore.

As described above, however, the depicted apparatus (10) can be used in conjunction with additional containers and/or apparatus containing additional fuel, or the depicted apparatus (10) can function as a carrier for a fuel load (20, 22) for use by an associated apparatus. Similarly, an initiation apparatus, an adapter, and/or other attachments and/or components can be threaded to, and/or otherwise engaged with, either end (14, 16) of the apparatus (10). The adapter, as described in detail below, may align the apparatus (10) and/or nozzle of the apparatus (10) with the obstruction, for penetrating, perforating, and/or eroding the obstruction. The configuration of the torch apparatus, with the adapter, can protect the wellbore, nipples, etc. from the medium, and otherwise deflect damage away from components of within the wellbore and the inner walls of the wellbore or casing while penetrating, perforating, and/or eroding the obstruction. The depicted apparatus (10) can comprise a stand-off member, an anchor and/or attachment/latching mechanism, or other similar components, as described above and below for positioning and orienting the apparatus (10).

Figure 2:
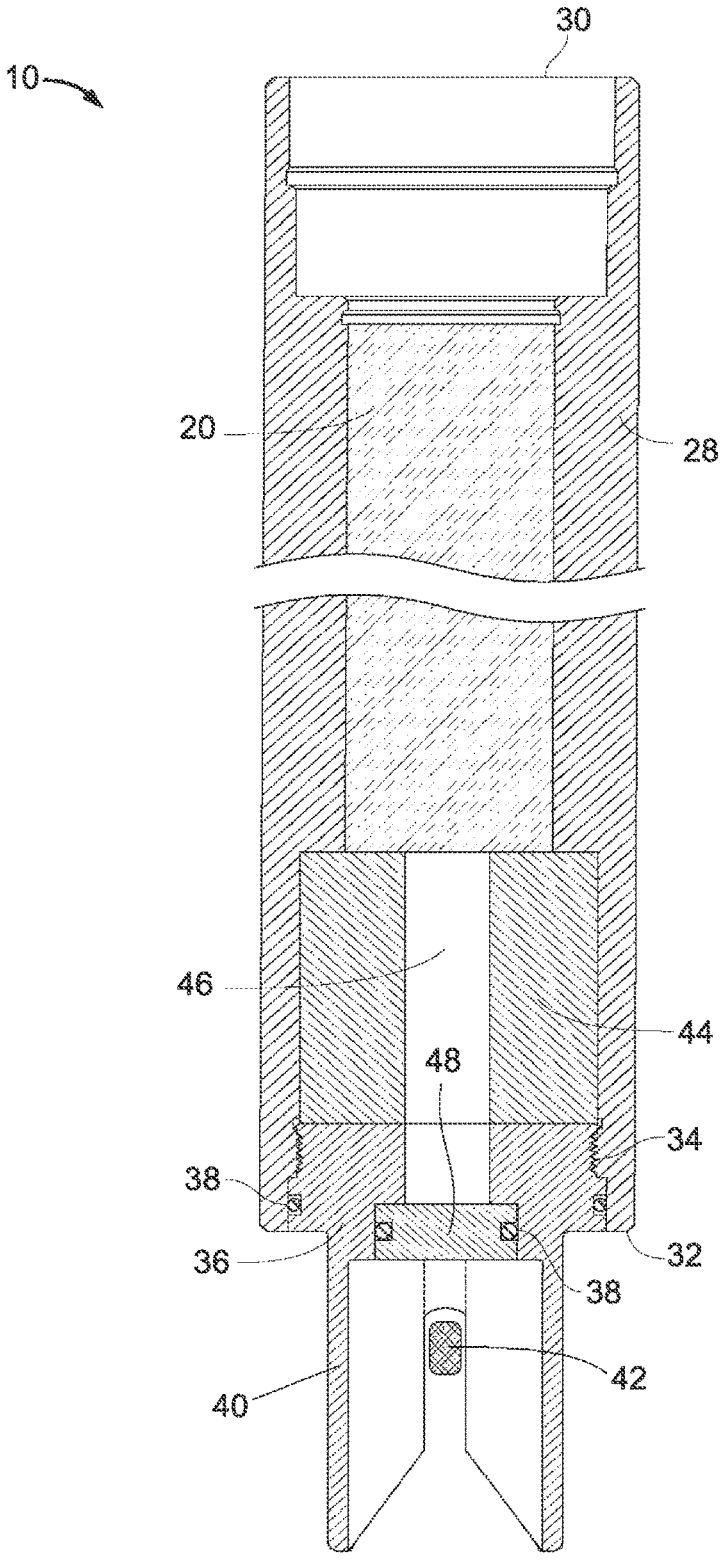
FIG. 2 depicts a cross-sectional view of an embodiment of an apparatus usable to project a medium and having an embodiment of an adapter of the present invention.

With the foregoing in mind, FIG. 2 shows a cross-sectional view of an embodiment of an apparatus (10) (e.g., a torch), having an embodiment of an internal adapter (36) usable within the scope of the present disclosure. The apparatus (10) is depicted having a generally tubular apparatus body (28) with a first end (30) having threads and/or a box connection, and a second end (32). The internal adapter (36) may be attached to the body (28) or may be integrally formed without separation between the body (28) and the internal adapter (36). In the illustrated embodiment, the second end (32) is depicted as attached to the body (28) with interior threads (34), usable for engagement, removal, or replacement of the internal adapter (36). Upon removal of the adapter (36), the adapter (36) may be replaced by a different adapter (36), or the same adapter (36) may be refurbished and reused. The internal adapter (36) is shown engaged with the apparatus body (28) via the threads (34), and a sealing member (38) (e.g., an O-ring or similar element) is shown secured between the internal adapter (36) and the interior surface of the apparatus body (28). As described above, the internal adapter (36) can be usable to align the apparatus (10) and/or nozzle of the apparatus (10) with the obstruction, protect the wellbore, nipples, etc. from the medium, and otherwise deflect damage away from components within the wellbore. Specifically, FIG. 2 shows the internal adapter (36) having a plurality of protruding elements (40) extending beyond the second end (32) of the apparatus body (28), which can protect the apparatus body (28) and the inside walls of the wellbore, such that the projection of the medium (e.g., molten thermite, projected fuel load), from the apparatus (10) and toward an obstruction (42), will be less likely to damage and/or otherwise affect the apparatus body (28) or the wellbore. The internal adapter (36), or specifically the protruding elements (40) can surround or partially surround (e.g., encapsulate, encircle, or partially encircle) the obstruction (42) for proper alignment with the targeted obstruction (42) and for providing the protection to the surrounding area of the wellbore. The protruding elements (40) may be specifically designed to form to the shape of the obstruction and/or downhole tool as described in detail below. For example, the protruding elements (40) may differ in length, width, or distance between the protruding elements (40) based on the specific obstruction (42). In other embodiments, the adapter and/or torch may surround the obstruction (42) or the downhole tool from above such that the adapter forms the female connection to the obstruction's male counterpart.

The depicted embodiment of the apparatus (10) is shown having an insert (44) disposed within the apparatus body (28), proximate to the second end (32), which in an embodiment, can be formed from graphite or a similar material that will remain generally unaffected by the consumption of a fuel load and the projection of a medium. The insert (44) is shown having an internal bore, which can be continuous with a bore through the internal adapter (36), defining a nozzle (46) at the second end (32) of the apparatus body (28). The internal adapter (36) is depicted having a seal and/or plug (48) engaged therewith, over the nozzle (46), with an associated O-ring or similar sealing member (38), such that the seal and/or plug (48) blocks the opening of the nozzle (46) while the apparatus (10) is lowered and/or otherwise positioned within the wellbore. The seal and/or plug (48) thereby prevent(s) the entry of contaminants into the nozzle (46) and apparatus body (28), until the apparatus (10) is actuated. Consumption of the fuel load (20) (e.g., thermite and/or a thermite-polymer mixture) causes projection of a medium (e.g., molten thermite, molten fuel, plasma, and/or gas) through the nozzle (46), which removes, severs, annihilates, penetrates, and/or otherwise degrades the seal and/or plug (48), and further affects an obstruction located in an axial direction relative to the apparatus (10) (e.g., proximate to the second end (32) thereof).

Figure 3:
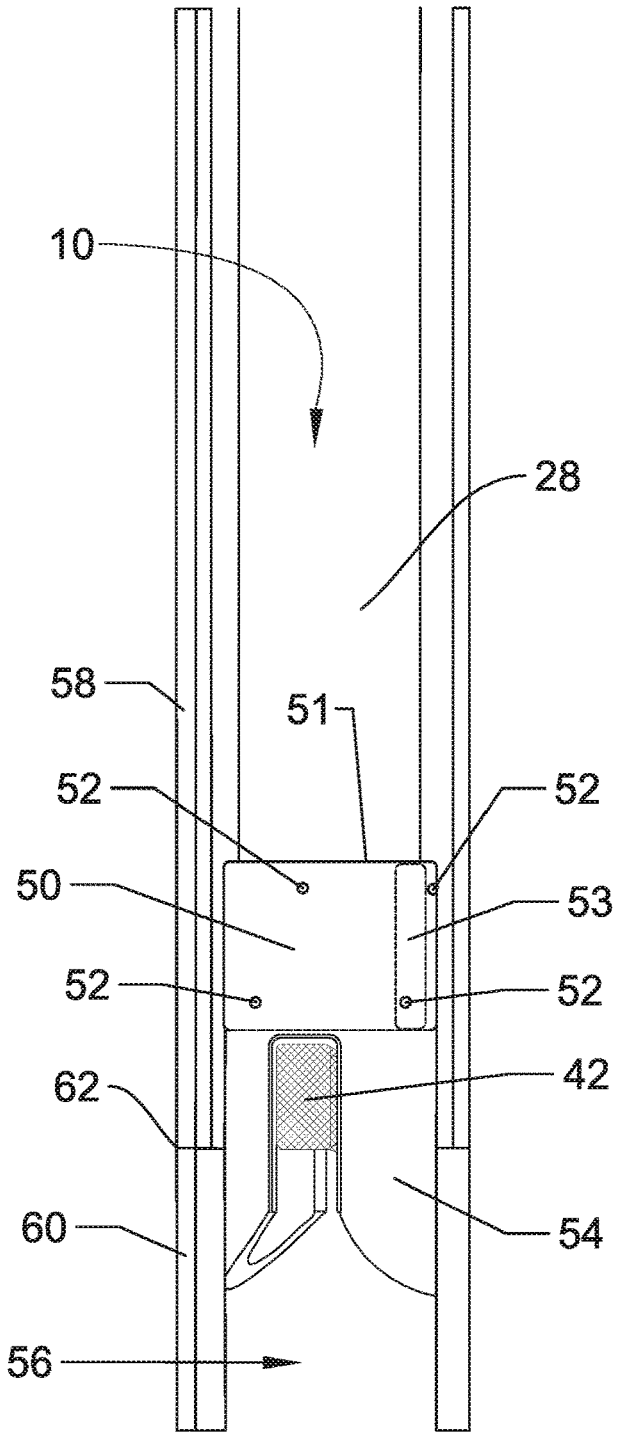
FIG. 3 depicts an embodiment of an adapter connected to an apparatus usable to project a medium within a wellbore.

It should be understood that the nozzle (46), the fuel load (20), the internal adapter (36), and other components of the apparatus (10) can be readily varied and/or provided having other dimensions, shapes, and/or forms without departing from the scope of the present disclosure. Furthermore, other embodiments of the adapter (36) may be attached to the apparatus body (28) as outlined below. For example, as illustrated in FIG. 3, the apparatus (10) shown in FIG. 2, may include an external adapter (50) that protrudes from the apparatus body (28), rather than threading into the internal threads (34). The external adapter (50) may be constructed integral to the apparatus body (28), with the nozzle (46) encased inside the external adapter (50).

In other embodiments, the external adapter (50) may be attached to the apparatus body (28) retroactively. In other words, the external adapter (50) may be configured to fit any apparatus (10). For example, as shown in FIG. 3, the external adapter (50) may be attached to the apparatus body (28) by sliding a top portion (51) of the external adapter (50) over the apparatus body (28) and tightening set screws (52) to maintain a secure connection. In certain embodiments, the apparatus body (28) may include a groove (53) into which the set screws (52) can be secured, which can ensure that the external adapter (50) does not independently rotate around the apparatus body (28). Other suitable attachment forms can be used to attach the external adapter (50) to the apparatus body (28). Below the top portion (51), the external adapter (50) can include protruding elements (54) that can align the external adapter (50) and the apparatus (10) over the obstruction (42), with the obstruction (42) being captured between the protruding elements (54). The obstruction (42) may include, for example, debris, components, tools, stuck valves, or other material that is blocking a wellbore (56). In addition, the obstruction (42) may include a blade or blade section that has lodged between a first pipe section (58) and a second pipe section (60) with a pipe joint (62) between the pipe sections (58, 60). As explained above, the protrusion elements (54) can prevent damage to an area (58, 60, 62) surrounding the obstruction (42).

Figure 4:
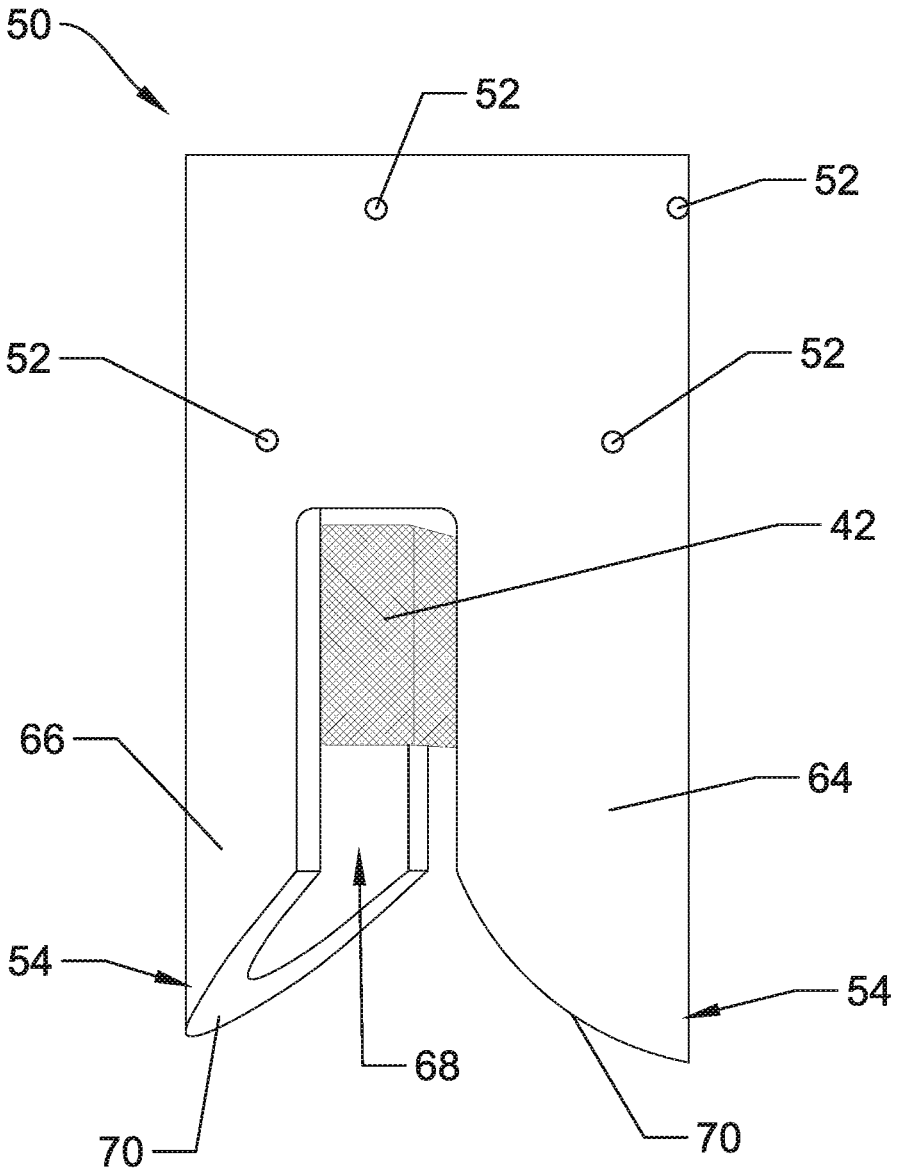
FIG. 4 depicts an embodiment an embodiment of an adapter of the present invention.

To protect the surrounding area (58, 60, 62) from the medium (e.g., projected fuel load, molten thermite) being released from the apparatus (10), particularly during severance and annihilation of the obstruction (42), the external adapter (50) can include structural protections that align and shield the surrounding area (58, 60, 62) during operation. As shown in FIG. 4, the external adapter (50) has protruding elements (54) that can include a first locating centralizer (64) and a second locating centralizer (66) that can contact the obstruction (42) to capture the obstruction (42) and orient the external adapter (50) relative to the obstruction (42). This centralizing of the external adapter (50) enables the external adapter (50) and the apparatus (10) to be centralized within the wellbore and properly aligned with, or over, the targeted obstruction (42). Such an alignment can ensure that the projected fuel load (e.g., molten thermite or molten thermite and a gas-producing polymer) is directed onto the obstruction, for a more efficient cutting, eroding, penetrating perforating or removal of the obstruction, thus minimizing or eliminating the amount of projected fuel load that contacts the surrounding area, including the surrounding wellbore or casing. In some embodiments, the first locating centralizer (64) may be longer than the second locating centralizer (66). This can ensure that when the apparatus (10) is lowered onto or over the obstruction (42), the external adapter (50) only contacts the obstruction (42) at the end of the first locating centralizer (64).

Between the locating centralizers (64, 66), the external adapter (50), in certain embodiments, can include an aligning slot (68) (e.g., a recessed area) that is usable to capture and surround the obstruction (42) during operation (e.g., initiation of the medium fuel). To ensure that the obstruction (42) is located within the aligning slot (68) during operation, the locating centralizers (64, 66) may include angled faces (70) that slide over the obstruction (42) as the apparatus (10) is lowered into position. The locating centralizers (64, 66) of the external adapter (50) further serve to align the connected apparatus (10) with the targeted obstruction (42) for ensuring a successful cutting, penetrating, perforating, or eroding of the targeted obstruction (42). Further, as set forth above, the protruding elements (54), including the locating centralizers (64, 66), serve to shield and protect the area (58, 60, 62) surrounding the targeted obstruction (42).

In an embodiment of the apparatus (10), a permanent or removable anchor can be included for positioning and preventing movement of the apparatus (10) relative to the wellbore (56), in addition to the use of the external adapter (50). For example, U.S. Patent Application Publication No. 2015/0345232, the disclosure of which is incorporated herein in its entirety, discusses the use of a torch apparatus that uses a permanent or removable anchor. In one embodiment, a section of the interior of the permanent or removable anchor can be provided with a plurality of grooves and/or a slotting or other means of selective clocking, orienting, or angling in a particular azimuthal direction.

The grooves can define a selected profile, which can engage a complementary profile that can be disposed in association with the apparatus (10), which is to be positioned within the wellbore (56), and at a desired or selected position. The selected profile can be defined by the spacing between the grooves, the depth of the grooves, the interior shape of the grooves, or other similar features usable to differentiate the selected profile from other features or profiles within the tubular string. In an embodiment of the present invention, the selected profile can be shaped to permit downward movement of a complementary profile into engagement, while preventing upward movement, such as through use of an upwardly facing no-go shoulder, or a similar element within the selected profile and/or the complementary profile. The positioning of the apparatus (10) with an anchoring device can minimize any movement of the apparatus (10) caused from any force, including forces associated with jarring, hammering, stroking, dissolving, cutting, and other similar forces.

In certain embodiments, the apparatus (10) can be relowered or repositioned into the wellbore (56), or lowered past a prior set positioning of the apparatus (10) within the wellbore (56). An example of locating a desired position, and positioning an apparatus at that desired position, is discussed in U.S Patent Publication No. 2015/0184476, the disclosure of which is incorporated herein in its entirety. Such methods, as clocking, provide the ability for an apparatus to re-enter a wellbore (56) and to be positioned in an exact prior position for performing an operation, which can be duplication or a partial duplication of a prior operation. In addition, a clocking method can be used to allow a future operation to be performed at an offset, which can include an angular offset of the apparatus or a positional offset of the location of the apparatus (e.g., a lower or higher depth within the wellbore, from the previous location within the wellbore, at which the prior operations were conducted). Examples regarding clocking, orienting, and/or rotating of an apparatus within a wellbore are described in U.S. Patent Publication Nos. 2013/0025883 and 2014/0262270, the disclosures of which are incorporated herein in their entireties.

Figure 5:
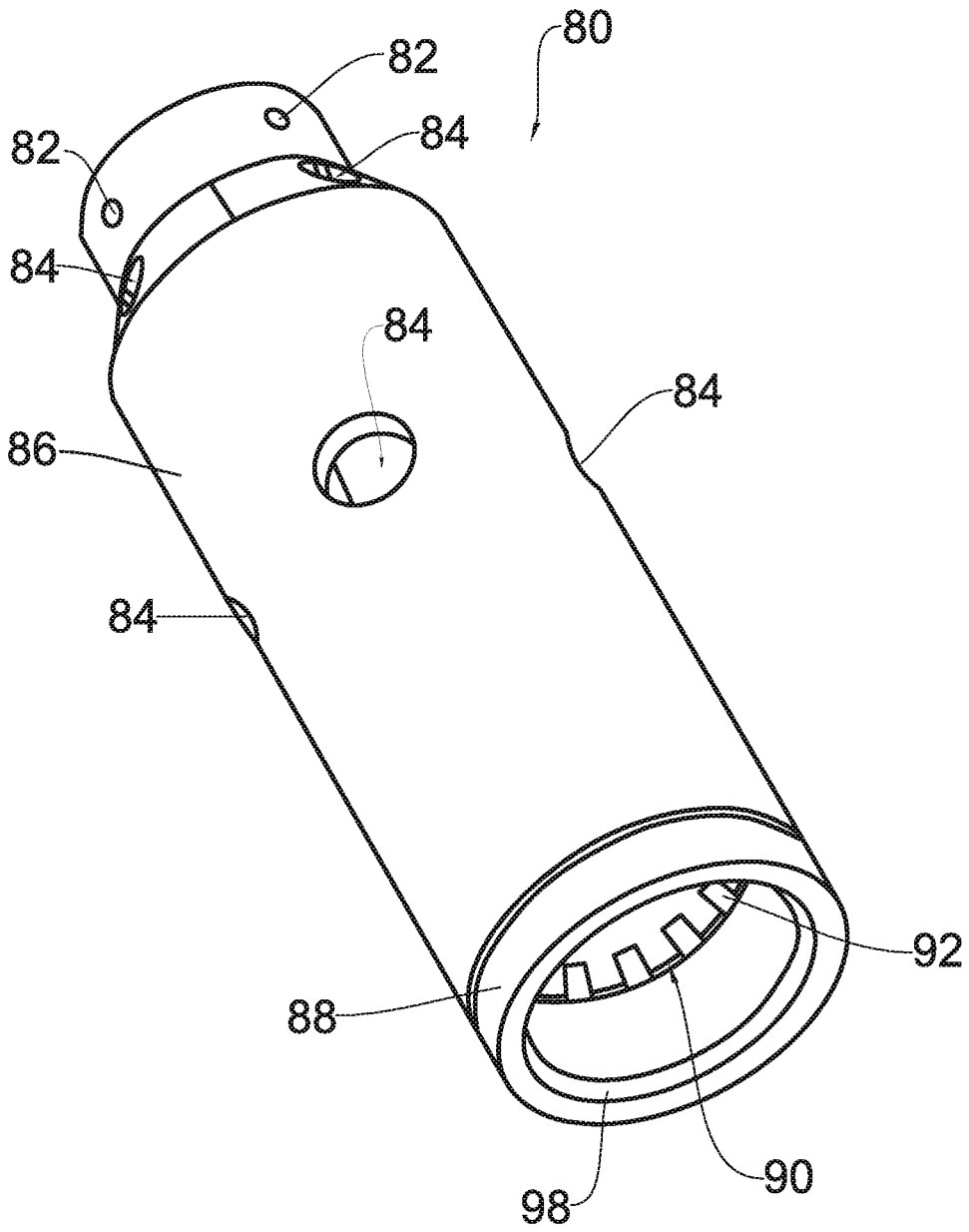
FIG. 5 depicts an embodiment of a grappling tool usable with the apparatus for projecting a medium.

FIG. 5 illustrates an embodiment of an adapter (80) for use with the apparatus (10). As mentioned above, the adapter (80) may be used as an integral form of the body (28) of the apparatus (10), or may be a modular external adapter attached with set screws (82). In particular, the adapter (80) can be used to grapple the obstruction (42) or a specific downhole tool (e.g., removable plug shown in FIGS. 8 and 9) for a highly localized projection of a medium into the downhole tool or through the downhole tool. The illustrated adapter (80) surrounds the obstruction (42) or a downhole tool almost completely, and may include vent holes (84) for the medium and/or gas to escape from the adapter (80) without excessive pressure causing separation from the obstruction (42) or downhole tool. The vent holes (84) may also allow material to pass through the adapter (80) while traveling downhole. In certain well situations, mud, dirt, or other solids can be compacted into the adapter (80), causing complications with the firing of the apparatus. The vent holes (84) reduce the likelihood of these complications. A lower piece (88) may be secured to the upper piece (86) to hold a tabs ring (90). The lower piece (88) may provide a female connection around a specific profile of the downhole tool such that a connection specific to the downhole tool may be customized. The tabs ring (90), as shown, can fit within a space between the upper piece (86) and the lower piece (88), and can include tabs (92) that protrude into the center of the adapter (80) to grapple to the downhole tool. The tabs (92) may flex as the adapter (80) is lowered around the downhole tool, which secures the downhole tool within adapter (80). The tabs (92) may also be configured to secure the downhole tool with a maximum flex force such that if the downhole tool is not destroyed, an upward pull (from an operator at the surface) buckles the tabs (92), releasing the adapter (80) and the apparatus (10).

Figure 6:
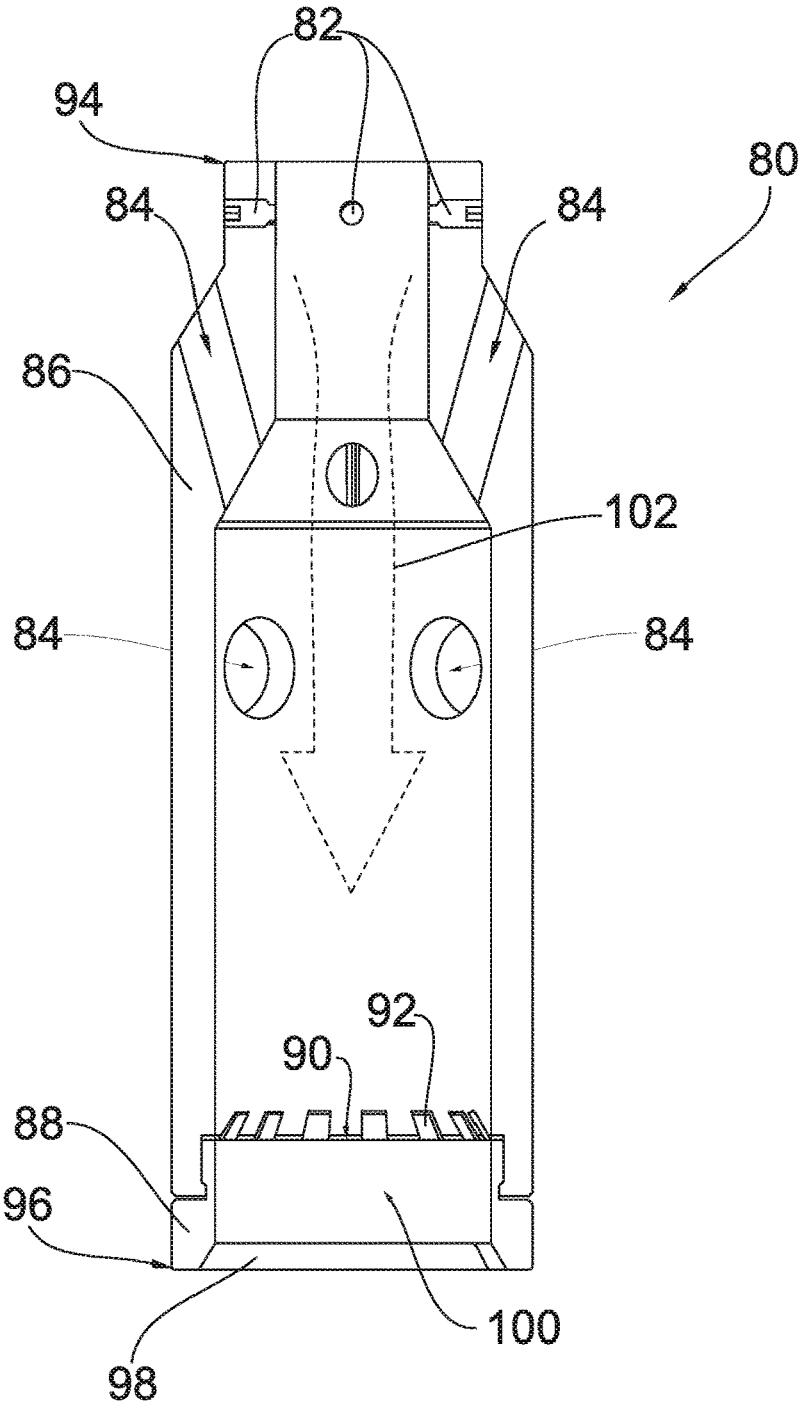
FIG. 6 depicts a cross-sectional view of the embodiment of the grappling tool adapter of FIG. 5.

Further illustrating the embodiment of FIG. 5, FIG. 6 shows a cross-sectional view of the adapter (80). As illustrated, the adapter (80) may be configured to attach to the apparatus (10) for producing the medium from the fuel load, at an upper end (94). The adapter (80) is also configured to at least partially surround the obstruction (42) or a downhole tool at a lower end (96). The lower end (96) includes a beveled edge (98) that guides the obstruction (42) or the downhole tool into an internal area (100) where the tabs (92) may secure the obstruction (42) or the downhole tool. Once the adapter (80) is secured in place (and held by the tabs 92), the apparatus 10 is initiated and the medium follows through a flow path (102) through the interior of the adapter (80). The medium then impinges on the top of the obstruction (42) or a downhole tool to annihilate the obstruction (42) or the downhole tool, or to begin a consumption process described in further detail below.

Figure 7:
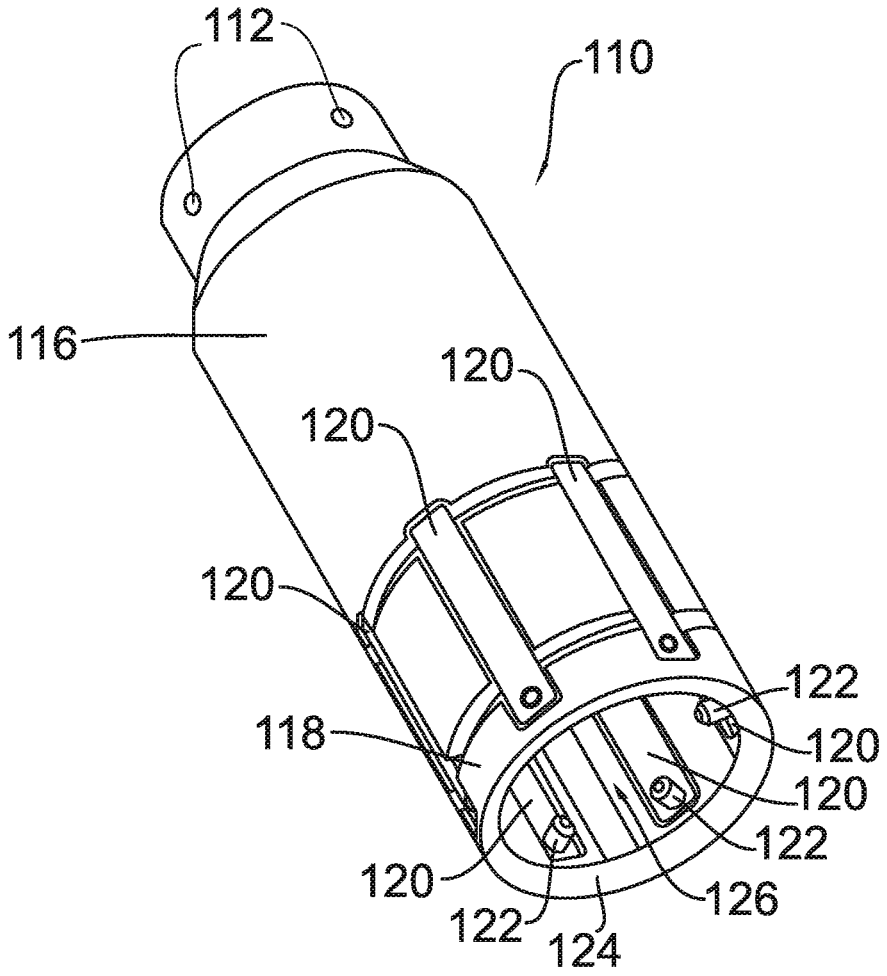
FIG. 7 depicts an embodiment of an adapter usable with the apparatus for projecting a medium.
Figure 8:
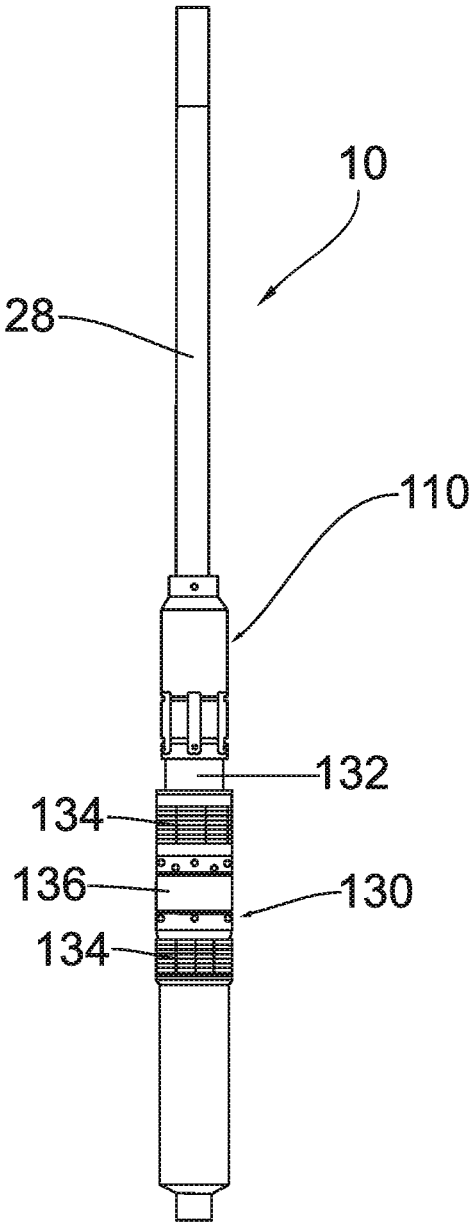
FIG. 8 depicts an embodiment of an adapter with an apparatus and a downhole tool usable within a wellbore.
Figure 9:
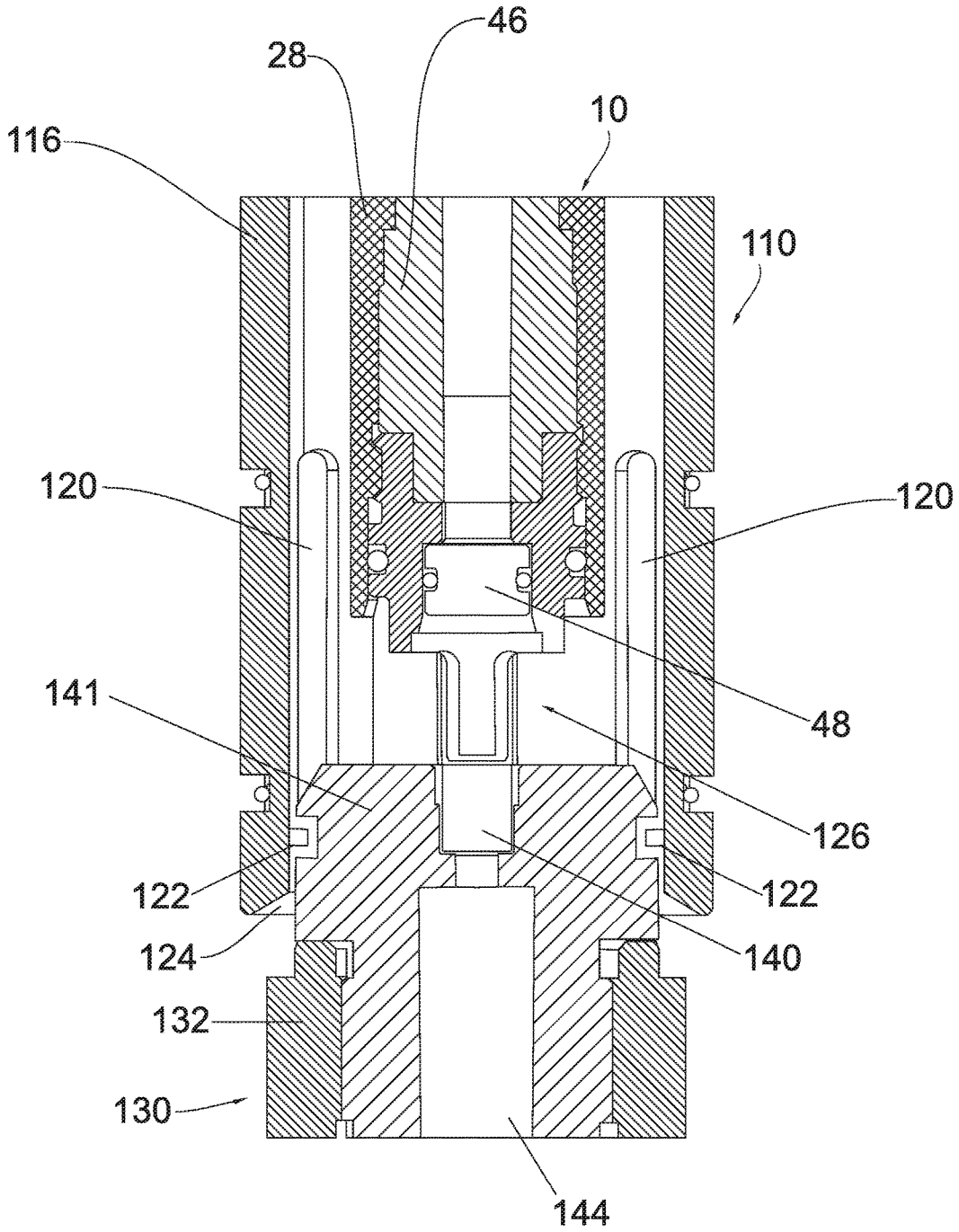
FIG. 9 depicts a cross-sectional view of an embodiment of the adapter, apparatus, and torch of FIG. 8.

FIG. 7 illustrates an embodiment of an adapter (110) that may be used in combination with the apparatus (10). Similar to the adapter (80) of FIGS. 5 and 6, the adapter (110) can be used to grapple the obstruction (42), or a specific downhole tool for a highly localized projection of a medium into the downhole tool or through the downhole tool. The adapter (110) may be secured to the apparatus (10) by set screws (112), in a similar manner to the adapters (36, 50, 80) above. The illustrated adapter (110) surrounds the obstruction (42) or a downhole tool almost completely, and may include a body (116) that does not have the vent holes (84) of the adapter (80) shown in FIGS. 5 and 6. At a bottom end (118) of the adapter (110), however, there are a one or more flaps (120) that may be configured to spring outward so that one or more teeth (122) may slip into a feature on the obstruction (42), or into a groove on a downhole tool. The groove on the downhole tool may, in certain embodiments, be included on the downhole tool specifically for engaging with the one or more teeth (122). That is, as the adapter (110) (with the attached apparatus (10)) is lowered over the downhole tool, the one or more flaps (120) are forced outward as the one or more teeth (122) pass over the top edge of the downhole tool. The one or more teeth (122) may then engage the groove such that the one or more flaps (120) spring back inward and the one or more teeth (122) capture the downhole tool. The adapter (110) may also include a beveled edge (124) that guides the downhole tool into an interior space (126) within the adapter (110). The teeth (122) are designed to shear under a predetermined load; therefore the user can pull to release the assembly from the obstruction below. A variation in the number of teeth (122) assembled within the tool string allows the user flexibility in the shear to release feature of the system An example of the adapter (110) capturing a downhole tool is illustrated in FIG. 8. Other tools (e.g., fishing tool, hanger, jar, packer, shock tool, etc.) may be captured or engaged by any of the adapters (36, 50, 80, 110), but the illustrated embodiment of FIG. 8 includes a plug (130). The plug (130) may be deployed in a wellbore previous to the interaction with any of the adapters (36, 50, 80, 110). The wellbore may include production tubing, casing, production liner or any other structure defining the walls of a wellbore. In certain embodiments, components of the plug (130) may expand to fill the wellbore; and therefore, the size of the plug (130) prior to deployment is not critical to all embodiments of the invention.

The plug (130) includes a mandrel (132) having a sealing member (136). The sealing member (136) is typically made of a deformable or otherwise malleable material, such as plastic, metal, an elastomer, or the like. The sealing member (136) is deformed when the plug (130) is deployed within the wellbore. The plug (130) includes slips (134) that may interact with other components (e.g., cone-shaped protrusions, setting tools, a threaded exterior of the plug (130), etc.) to apply pressure to the sealing member (136) and compress it so that the sealing member (136) deforms outwardly against the wellbore to form a tight seal. Once the pressure of the sealing member (136) against the wellbore exceeds a certain calibrated value, continued squeezing can cause the slips (134) to deform outwardly. Ultimately, the slips (134) will deform outwardly enough that teeth on the outside of the slips (134) will bite into the wellbore to secure the plug (130) within the wellbore. Securing the plug (130) seals the volume below the plug (130) from the volume above the plug (130).

The apparatus (10) and the adapter (36, 50, 80, 110) may be used to remove the plug (130) from the location into which it was set within the wellbore. That is, the apparatus (10), with the adapter (36, 50, 80, 110), may engage the plug (130) and project the medium through the adapter (36, 50, 80, 110) and onto or into the plug (130). The medium then interacts with the plug (130) to melt, corrode, consume, deteriorate, erode, dissolve, or otherwise destroy the plug (130) from the top toward the bottom. In certain embodiments, the plug (130) may include internal components that aid the process of consuming the plug (130). An example of one embodiment of an adapter (36, 50, 80, 110) attached to a self-consuming plug is illustrated in the cross-sectional view of FIG. 9. As described in detail above, the apparatus (10) may include a fuel load that is initiated and flows through the nozzle (46) and is projected passed the seal (48) and into the interior space (126) of the adapter (110). The nozzle (46) shapes the medium so that it penetrates a seal (140) on a cap end (141) of the plug (130). After passing through the seal (140), the medium flows into and fills a gap (144). As the medium contacts the inside diameter of the mandrel (132) and reacts with the mandrel material, the mandrel material begins to degrade.

As the molten fuel mixture fills up the gap (144), the molten fuel mixture is held in contact with the inner diameter of the mandrel (132) for a longer amount of time than would be the case if the molten fuel mixture were allowed to freely flow out of the mandrel (132). Also, the restricted flow allows an elevated pressure of the molten fuel mixture to build. The increased residence time of the molten fuel mixture in contact with the mandrel, and the pressurization of the molten fuel mixture, can facilitate the eradication of the mandrel material.

The mandrel (132) may, for example, be constructed of a material such as magnesium, which can react with the medium and change into magnesium oxide, which easily deteriorates, destroying the plug (130). As the molten fuel material eradicates the mandrel material within the plug (130), the structural support is compromised, ultimately causing the plug (130) to fail. The flow of the medium can be calibrated to optimize the residence time and pressure of the molten fuel mixture within the inside of the mandrel (132). Specifically, the molten fuel mixture should be contained within the mandrel (132) for long enough and at a high enough pressure to cause catastrophic failure of the integrity of the plug (130), but not so long that the molten fuel mixture (or the heat generated thereby) causes damage to the formation, the casing, production tubing, or other wellbore components. Once the mandrel (132) has failed, a portion of the cap end (141) may remain due to incomplete annihilation from the medium. The remaining portion of the cap end (141) is retrieved to the surface while attached to the adapter (110).

Embodiments usable within the scope of the present disclosure thereby provide apparatus and methods usable to penetrate, perforate, and/or erode a target that presents a blockage, hindrance to travel, and/or inadequate flow path in a wellbore, through the projection of a medium from an apparatus aligned with the obstruction in an axial (e.g., downhole or uphole) direction to affect the obstruction. The apparatus and adapter may be used to attach to, and eradicate, a downhole tool, as well. The alignment device or adapter captures the targeted obstruction or the downhole tool, aligns the apparatus with the targeted obstruction or the downhole tool for penetrating, perforating, cutting, and/or eroding away of the targeted obstruction or downhole tool. Further, the alignment device or adapter prevents or diminishes the amount of damage to the area surrounding the targeted obstruction within the wellbore.

While various embodiments usable within the scope of the present disclosure have been described with emphasis, it should be understood that within the scope of the appended claims, the present invention can be practiced other than as specifically described herein.

The invention claimed is:

1. An apparatus to modify or remove an obstruction or a downhole tool within a wellbore, comprising:

a tubular body comprising a first end and a second end and configured to contain a fuel load and an initiator, wherein the fuel load is initiated to produce a molten thermite;

a nozzle positioned at the second end of the tubular body and configured to project the molten thermite onto the obstruction or the downhole tool; and a first adapter configured to attach to the tubular body, wherein the first adapter comprises a seal between the first adapter and the tubular body and one or more protruding elements configured to align the nozzle over the obstruction or the downhole tool, wherein the first adapter is configured to at least partially surround the obstruction or the downhole tool such that the aligned nozzle projects the molten thermite directly onto the obstruction or the downhole tool, wherein the first adapter forms a barrier between a surrounding area of the wellbore and the projected molten thermite, and wherein the one or more protruding elements comprises a side wall, and the side wall includes an opening into the first adapter.

2. The apparatus of claim 1, further comprising a downhole perforating torch, a downhole cutting torch, an axial pyro torch, or combinations thereof.

3. The apparatus of claim 1, wherein the apparatus is configured to erode the obstruction or the downhole tool, degrade the obstruction or the downhole tool, cut through the obstruction or the downhole tool, penetrate through the obstruction or the downhole tool, perforate the obstruction or the downhole tool, or remove the obstruction or the downhole tool.

4. The apparatus of claim 1, wherein the tubular body is configured to contain thermite or thermite and one or more gas-producing polymers as the fuel load.

5. The apparatus of claim 1, wherein the nozzle comprises a selected geometry that corresponds to a shape of the obstruction or the downhole tool, allows positioning of the nozzle proximate to the obstruction or the downhole tool, enhances the effectiveness of the apparatus for removing the obstruction or the downhole tool, or combinations thereof.

6. The apparatus of claim 1, wherein the nozzle is adapted to project the molten thermite in a direction generally parallel to an axis of the wellbore and in a downhole or uphole direction.

7. The apparatus of claim 1, wherein the first adapter comprises one or more locating centralizers to guide and centralize the apparatus for acting on the obstruction or the downhole tool.

8. The apparatus of claim 7, wherein the one or more locating centralizers comprise angled faces that slide over the obstruction or the downhole tool as the apparatus is positioned to align the nozzle with the obstruction or the downhole tool.

9. The apparatus of claim 1, further comprising an anchoring device to position the apparatus and minimize movement of the apparatus during projection of the molten thermite.

10. The apparatus of claim 1, wherein the downhole tool comprises a consumable plug.

11. The apparatus of claim 1, wherein the connection between the first adapter and the tubular body further comprises a threadable connection, fasteners, set screws, or combinations thereof.

12. The apparatus of claim 1, wherein the one or more protruding elements extend from the second end of the apparatus to form the barrier for protecting the apparatus and the surrounding area of the wellbore during the projection of the molten thermite.

13. The apparatus of claim 1, wherein the first adapter comprises a plug that is sealed over or onto the nozzle to prevent contamination of the nozzle prior to projection of the molten thermite.

14. The apparatus of claim 13, wherein the projection of the molten thermite erodes or removes the plug.

15. The apparatus of claim 1, comprising a second adapter configured to attach to the tubular body in replacement of the first adapter.

16. The apparatus of claim 15, wherein the second adapter comprises one or more protruding elements comprising geometry different from the first adapter.

17. The apparatus of claim 1, wherein the surrounding area comprises areas above and below the obstruction or the downhole tool.

18. A method of modifying or removing an obstruction from a wellbore, comprising:

lowering an apparatus into a wellbore, wherein the apparatus comprises:

a tubular body containing a fuel load;

a nozzle positioned at a second end of the tubular body and configured to project molten thermite onto the obstruction; and a first adapter configured to attach to the tubular body, wherein the first adapter comprises a seal between the first adapter and the tubular body and comprises one or more protruding elements configured to align the nozzle over the obstruction, wherein the one or more protruding elements comprises a side wall, and the side wall includes an opening into the first adapter, and wherein the first adapter forms a barrier between a surrounding area of the wellbore and the molten thermite;

aligning the nozzle over the obstruction with a first protruding element of the one or more protruding elements, wherein the first adapter is configured to at least partially surround the obstruction;

initiating the fuel load to produce the molten thermite;

projecting the molten thermite through the aligned nozzle to modify or remove at least a portion of the obstruction with the projected molten thermite; and preventing damage to a first area of the wellbore surrounding the obstruction with the one or more protruding elements.

19. The method of claim 18, comprising:

retrieving the apparatus from the wellbore;

replacing the first external adapter with a second external adapter;

lowering the apparatus into the wellbore with the second external adapter; and initiating an additional fuel load onto the obstruction.

20. An adapter for a downhole apparatus usable for modifying or removing a downhole tool in a wellbore, comprising:

a body comprising a nozzle at a first end of the body, wherein the nozzle is configured to project molten thermite;

at least one protruding element configured to protrude from the first end of the body, wherein the at least one protruding element comprises a side wall, and the side wall includes a vent opening into the adapter, and wherein the protruding element comprises a specific shape that at least partially surrounds a specific profile of the downhole tool when the downhole apparatus is lowered into the wellbore; and securing structures configured to maintain a connection between the adapter and the downhole tool while the nozzle projects the molten thermite.

21. The adapter of claim 20, wherein the securing structures are configured to buckle or shear in response to a predetermined load.

22. The adapter of claim 20, wherein the securing structures comprise tabs, a tab ring, teeth, or combinations thereof.

* * * * *